US005918296A

United States Patent [19]

Ishida et al.

[11] Patent Number: 5,918,296

[45] Date of Patent: Jun. 29, 1999

[54] CLOSING CONTROL DEVICE FOR FALLBOARD

[75] Inventors: Muneo Ishida; Tatsuo Furukawa, both of Shizuoka-ken, Japan

[73] Assignee: Kabushiki Kaisha Kawai Gakki Seisakusho, Shizuoka, Japan

[21] Appl. No.: 08/930,387

[22] PCT Filed: Feb. 13, 1997

[86] PCT No.: PCT/JP97/00374

§ 371 Date: Sep. 30, 1997

§ 102(e) Date: Sep. 30, 1997

[87] PCT Pub. No.: WO97/30437

PCT Pub. Date: Aug. 21, 1997

[30] Foreign Application Priority Data

Feb. 16, 1996 [JP] Japan ..... 8-54268
May 20, 1996 [JP] Japan ..... 8-148601

[51] Int. Cl.[6] ..... G10C 3/00; G10C 3/02

[52] U.S. Cl. ..... 84/179; 84/80; 84/177; 84/178

[58] Field of Search ..... 84/80–82, 177–183

[56] References Cited

U.S. PATENT DOCUMENTS 5,056,396 10/1991 Furukawa ..... 84/179
5,175,386 12/1992 Kuwahara ..... 84/179

FOREIGN PATENT DOCUMENTS 54-81717 6/1979 Japan .
56-3748 1/1981 Japan .
57-150891 9/1982 Japan .
5-313653 11/1993 Japan .
5-48238 12/1993 Japan .
6-17188 5/1994 Japan .
8-109940 4/1996 Japan .

*Primary Examiner*—William M. Shoop, Jr.
*Assistant Examiner*—Marlon T. Fletcher
*Attorney, Agent, or Firm*—Evenson, McKeown, Edwards and Lenahan

[57] ABSTRACT

There is provided a closing control device for a fallboard of a piano. A fallboard support is detachably mounted on a body of the piano, and the fallboard is rotatably attached to the fallboard support. A linkage has one end thereof connected to the fallboard. A slow closing device is fixed to the fallboard support, and has the other end of the linkage connected thereto, for braking the fallboard by way of the linkage when the fallboard rotates in a closing direction.

7 Claims, 6 Drawing Sheets

CLOSING CONTROL DEVICE FOR FALLBOARD

TECHNICAL FIELD

This invention relates to a closing control device for controlling the opening and closing of a fallboard of a hinged type which is employed particularly in upright pianos and upright electric pianos.

BACKGROUND ART

Conventionally, a fallboard of the above-mentioned type has a rear end thereof hinged to a fallboard support. The fallboard is rotated about a hinge for opening and closing of the same. Particularly, to close the fallboard, it is pulled forward and rotated until the bottom of a front end thereof contacts or rests on the top of a keyslip. This manner of closing/opening the fallboard has an inconvenience that if the closing operation is not properly carried out, the fallboard rotates with force by gravity to bump against the keyslip, so that a damage can be caused to the keyslip or fallboard, or user's finger(s) can be caught between the fallboard and the keyslip.

To eliminate the inconvenience, a closing control device is provided for the fallboard, one conventional type of which is comprised of a slow closing device which is formed by a one-way torque hydraulic damper and fixed to an arm or keybed of the piano, and a linkage connecting between the slow closing device and the fallboard. According to the construction of the conventional closing control device, when the fallboard is rotated in a closing direction, the braking force of the slow closing device acts on the fallboard via the linkage to cause the fallboard to close slowly.

However, the conventional closing control device suffers from a problem of difficulty in fulfilling the requirement of JIS (Japanese Industrial Standards) S 8507-1975 prescribing a manner of mounting and removing of the fallboard. That is, the JIS defines that the fallboard of the upright piano should permit mounting and detachment thereof without using any tool or the like. In the conventional closing control device, however, the slow closing device is fixed to the arm or keybed forming part of the body of the piano, and linked to the fallboard via the linkage, so that in detaching the fallboard from the body of the piano, it is required to separate at least component parts connected to each other at one point of a chain of connected component parts arranged between the fallboard and the slow closing device. Therefore, to fulfill the requirement of the JIS, the closing control device should be constructed such that the component parts to be separated are separable from each other without using any tool or the like. The closing control device thus constructed, however, suffers from the inconvenience that these separable component parts tend to be disconnected when the fallboard is opened and closed, so that it is difficult to open and close the fallboard in a stable manner.

DISCLOSURE OF INVENTION

It is the object of the invention to provide a closing control device for a fallboard of a piano, which enables the fallboard to be opened closed in a stable manner, and easily be detached from the piano without using any tool or the like.

To attain the above object, the invention provides a closing control device for a fallboard of a piano having a body, comprising a fallboard support which is detachably mounted on the body of the piano, and to which the fallboard is rotably attached, a linkage having one end and another end, the one end of the linkage being connected to the fallboard, and a slow closing device which is fixed to the fallboard support and has the another end of the linkage connected thereto, for braking the fallboard by way of the linkage when the fallboard rotates in a closing direction.

According to the closing control device of the invention, when the fallboard is closed, the slow closing device brakes the fallboard by way of the linkage during rotation of the fallboard in a closing direction. As a result, the fallboard is decelerated and closed properly and slowly. Further, since the slow closing device is fixed to the fallboard support which is detachably mounted on the body of the piano, the fallboard can be mounted on and detached from the body of the piano, as part of an assembly of the fallboard, the fallboard support, the slow closing device, and the linkage. Therefore, the fallboard can be easily mounted and detached without using any tool or the like, to fulfill the requirement of JIS S 8507-1975, and can be opened and closed in a stable manner without possibility of accidental removal thereof from the piano.

Preferably, the slow closing device is fixed to a bottom of the fallboard, the one end of the linkage being fixed to the bottom of the fallboard.

According to this preferred embodiment, when the fallboard is opened, most part of the slow closing device and the linkage is concealed under the fallboard support, with only a portion of the linkage being barely perceived from under the fallboard. This is favorable from a viewpoint of the appearance of the piano.

Alternatively, the one end of the linkage is received in a recess formed in a side of the fallboard in a manner such that the one end of the linkage is in flush with the side of the fallboard, and fixed to the recess.

According to this preferred embodiment, the one end of the linkage cannot be perceived from the front when the fallboard is opened, since it is received in the recess of the side of the fallboard in a manner such that the one end of the linkage is in flush with the surface of the side of the fallboard. This enhances the appearance of the piano.

Preferably, the body of the piano includes at least a pair of arms, the fallboard support being detachably mounted on the pair of arms.

More preferably, each of the pair of arms has at least two projections extending inward therefrom, the fallboard support having fallboard-fitting blocks extending from a bottom thereof, the fallboard support being detachably mounted on the pair of arms by fitting the fallboard support-receiving blocks between respective sets of the at least two projections of the each of the pair of arms.

Preferably, the slow closing device comprises a one-way torque hydraulic damper.

Preferably, the linkage comprises two link bars rotatably connected to each other, one of the two link bars including the one end of the linkage, while another of the two link bars including the another end of the linkage.

BEST MODE OF CARRYING OUT THE INVENTION

Now, the invention will be described in detail with reference to the drawings showing embodiments therefor.

Figure 1:
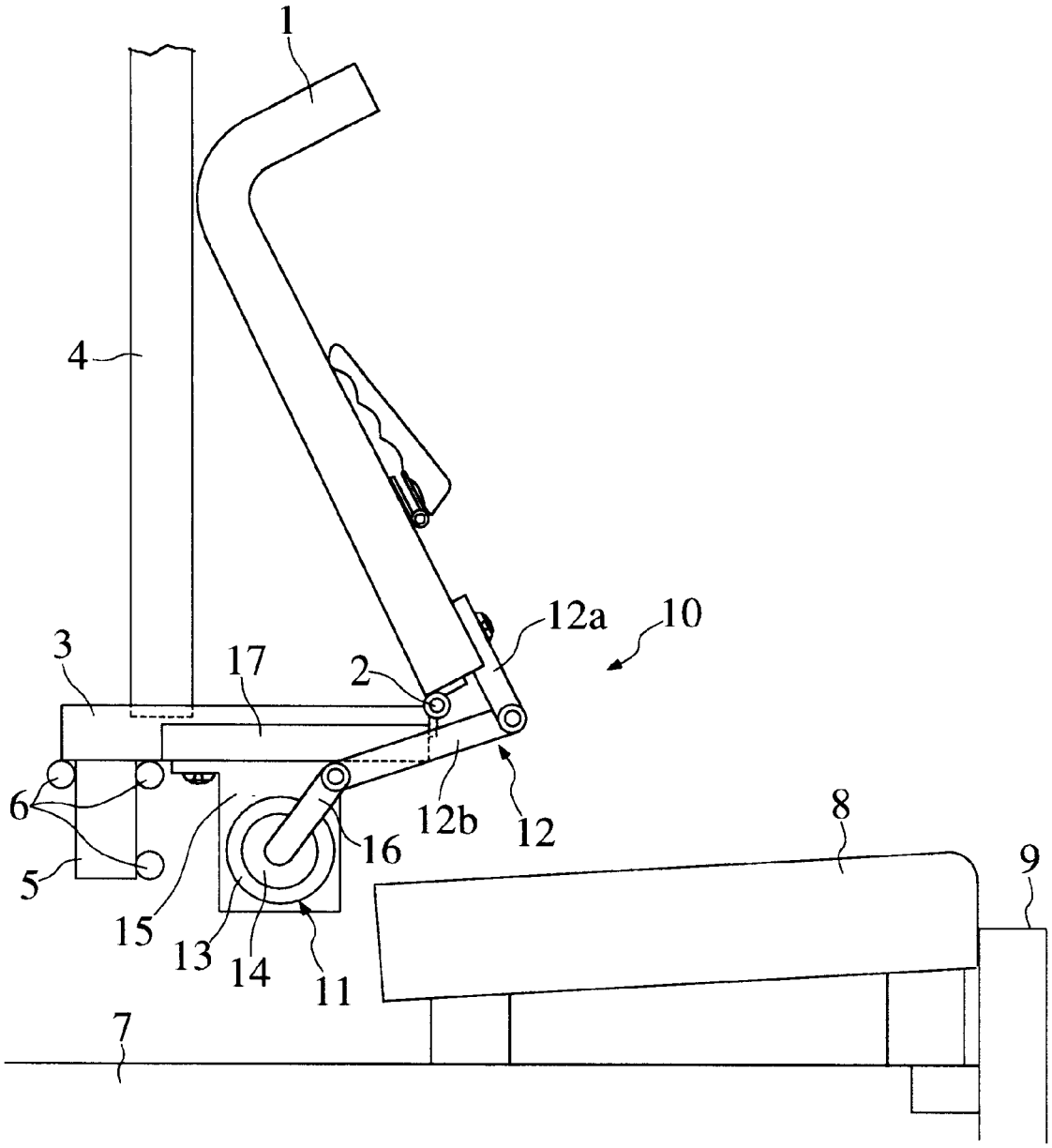
FIG. 1 is a side elevation of a closing control device for a fallboard of an upright piano, according to a first embodiment of the invention, and component parts associated with the closing control device, with the fallboard being in an open state.
Figure 2:
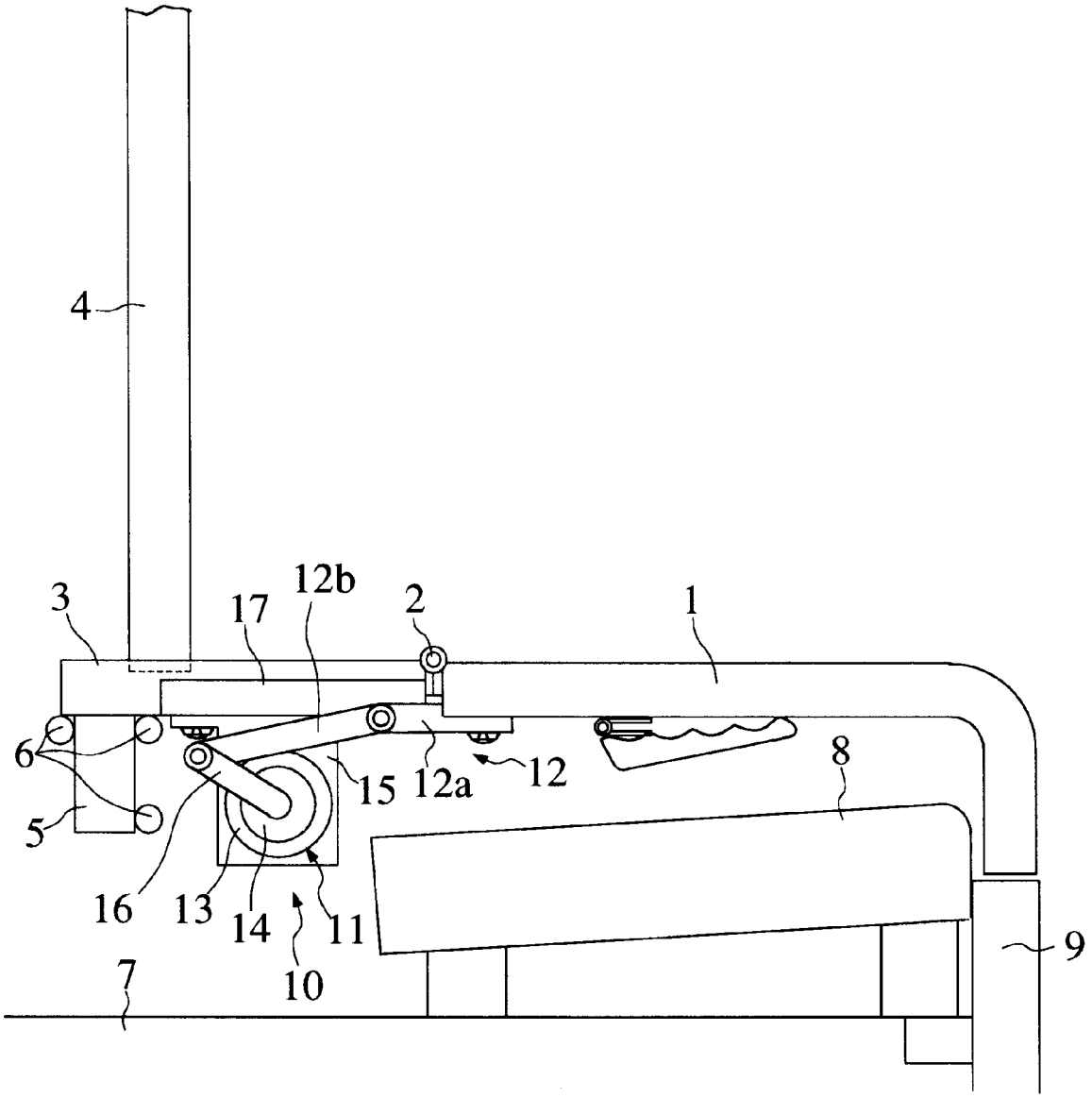
FIG. 2 is a side elevation similar to FIG. 1, with the fallboard being in a closed state.

Referring first to FIG. 1, there is shown a fallboard (which may be also called "a fallboard main section") 1 of an upright piano and a closing control device therefor according to a first embodiment of the invention. The fallboard 1 is formed e.g. of a laminated wood, and has a laterally oblong rectangular shape in plan view and an inverted L-shape in cross-section. The fallboard 1 has a rear end thereof rotatably connected to a front end of a fallboard support (which may be also called "a fallboard back section") 3 by a hinge 2, whereby it is opened and closed through rotation about the hinge 2 between an open position shown in FIG. 1 and a closed position shown in FIG. 2.

Figure 6:
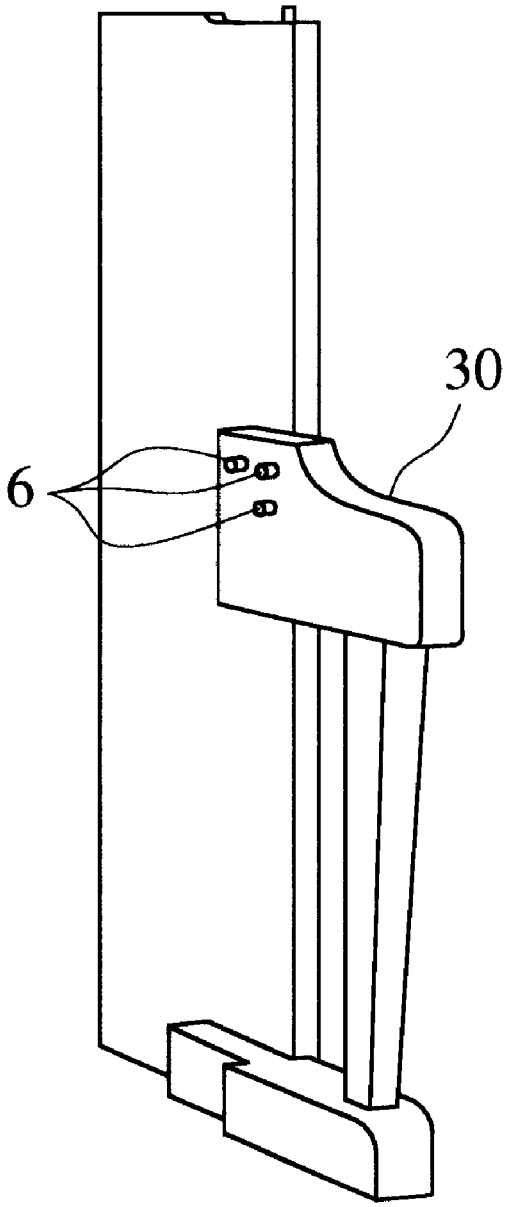
FIG. 6 is a perspective showing an arm and fallboard support-receiving bars together with component parts assembled therewith.

The fallboard support 3 is formed of a laminated wood or the like, and constructed such that it can be detached from a body of the piano including a pair of arms 30 one of which is shown in FIG. 6. More specifically, the fallboard support 3 has fallboard-fitting blocks 5 fixed to the bottom of a rear end thereof such that the fallboard-fitting blocks 5 extend downward from respective side portions of the bottom of the rear end of the fallboard support 3, and is detachably mounted on the arms 30 by fitting the fallboard-fitting blocks 5 from above between respective sets of three fallboard-receiving bars 6 projecting inward from the arms 30 of the body of the piano (see FIG. 6). In the figure, reference numeral 4 designates an upper panel detachably mounted on the fallboard support, 7 a keybed, 8 a cheekblock, and 9 a keyslip attached to the front of the keybed 7. The fallboard 1 abuts or rests on the keyslip 9 when it is in the closed position.

The closing control device 10 according to the embodiment is essentially comprised of a slow closing device 11 for braking the rotation of the fallboard 1 to the closed position and a linkage 12 for transmitting the braking force of the slow closing device 11 to the fallboard 1.

The slow closing device 11 is comprised of a casing 13, and a one-way torque hydraulic damper, which has a shaft 14 rotatably fitted through the casing 13. The casing 13 is fastened to the bottom of the fallboard support 3 at a side portion thereof by screws. The slow closing device 11 brakes the motion of the shaft 14 only when the shaft 14 rotates in an anticlockwise direction as viewed in FIG. 1, but does not brake the motion of the shaft 14, i.e. it is idle with no load thereon when the shaft 14 rotates in a clockwise direction. Further, the barking force generated by the slow closing device 11 progressively increases as the rotational angle of the shaft 14 in the clockwise direction increases. Further, the shaft 14 has a connection arm 16 formed integral therewith such that it extends radially from the center of an outer side end of the shaft 14.

The linkage 12 is comprised of two link bars 12*a*, 12*b* rotatably connected to each other, with one 12*a* being screwed to the bottom of a rear end of the fallboard 1, and the other 12*b* being rotatably connected to an end of the connection arm 16 of the shaft 14. Further, the fallboard support 3 has a cutout 17 formed in the bottom thereof to provide clearance for these link bars 12*a*, 12*b* to thereby prevent the link bars 12*a*, 12*b* from interfering with the fallboard support 3.

Figure 3:
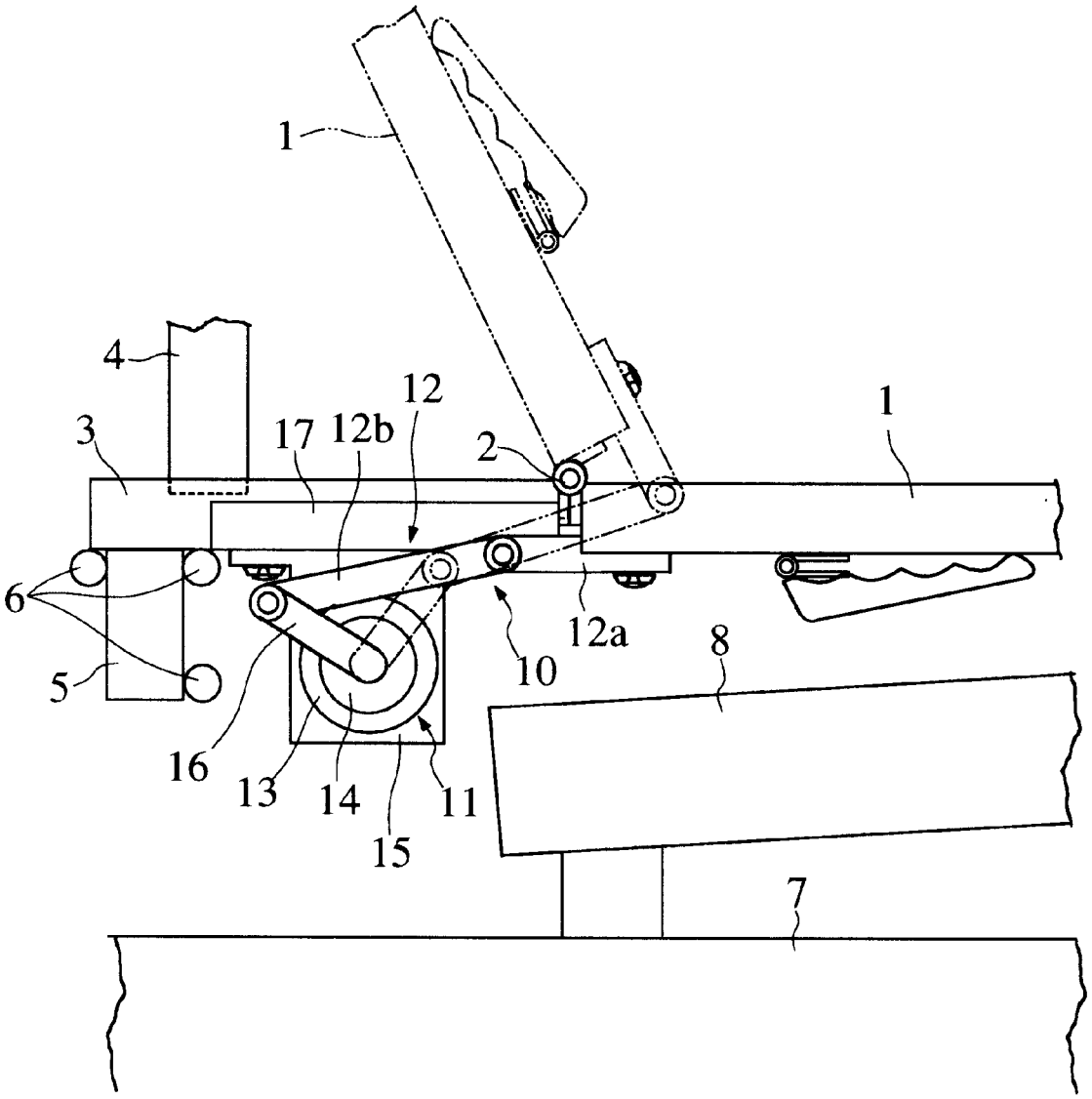
FIG. 3 is a fragmentary side view, on an enlarged scale, of the closing control device, which is useful in explaining the operation of the closing control device.

Next, the operation of the closing control device 10 constructed as above will be described. Referring to FIG. 3, the fallboard 1 shown by the solid lines is in its closed position similarly to FIG. 2. In this closed position, the fallboard 1 is at the limit of clockwise rotation thereof with the front end portion contacting or resting on the keyslip 9, to cover a keyboard, not shown, and the cheekblocks 8. Further, the shaft 14 connected to the fallboard 1 via the linkage 12 is at the limit of anticlockwise rotation thereof.

When the fallboard 1 is pulled upward from the closed position, the fallboard 1 is rotated in the anticlockwise direction or toward the rear side of the piano, and the shaft 14 of the slow closing device 11 is rotated in the clockwise direction by the pulling force of the linkage 12. This rotation terminates when the rim of the front end of the fallboard 1 is brought into contact with the upper panel 4, whereby the fallboard 1, the linkage 12, and the shaft 14 reach the open position shown by solid lines in FIG. 1 and two-dot chain lines in FIG. 3. As described above, during this rotation toward the open position, no braking force by the slow closing device 11 does not act, so that the fallboard 1 can be easily opened.

When the fallboard 1 is caused to fall forward from the open position, the fallboard 1 rotates in the clockwise direction as viewed in FIG. 1. During this rotation, the braking force generated by the slow closing device 11 acts on the fallboard 1 by way of the linkage 12, whereby the rotation of the fallboard 1 is decelerated to cause the fallboard to close slowly. Further, the braking force of the slow closing device 5 increases as the fallboard 1 comes nearer to the closed position, so that at termination of the closing of the fallboard 1 where the rotational speed of the fallboard 1 readily increases, the braking force of the slow closing device becomes the maximum, enabling slow closing of the fallboard 1.

According to the closing control device 10 of the present embodiment, the slow closing device 10 is fixed to the fallboard support 3 which is constructed detachable from the body of the piano, and hence it is possible to detach the fallboard 1, the fallboard support 3, the slow closing device 11, and the linkage 12, as a unit, from the body of the piano. Therefore, it is easy to fulfill the requirements of JIS S 8507-1975 that the fallboard should be detached from the body of the piano without using any tool or the like, and moreover the fallboard 1 can be closed and opened in a stable manner without possibility of accidental removal of the fallboard 1 from the piano. Further, when the fallboard 1 is opened, most part of the slow closing device 11 and the linkage 12 is concealed under the fallboard support 3, with only a portion of the linkage 12 being barely perceived from under the fallboard 1, which is favorable from a viewpoint of the appearance of the piano.

Figure 4:
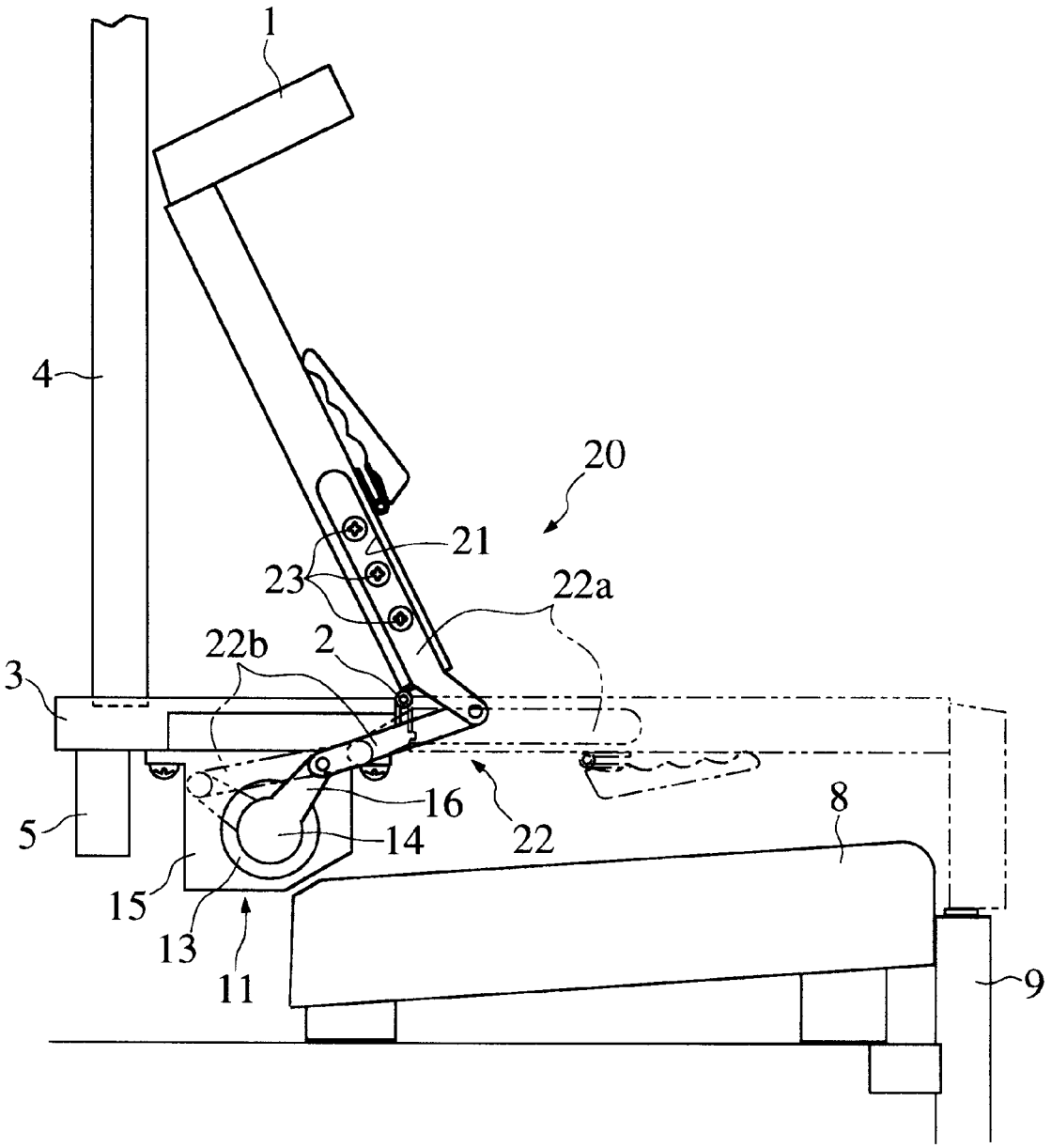
FIG. 4 is a side elevation of a closing control device for a fallboard of an upright piano, according to a second embodiment of the invention, and component parts associated with the closing control device.
Figure 5:
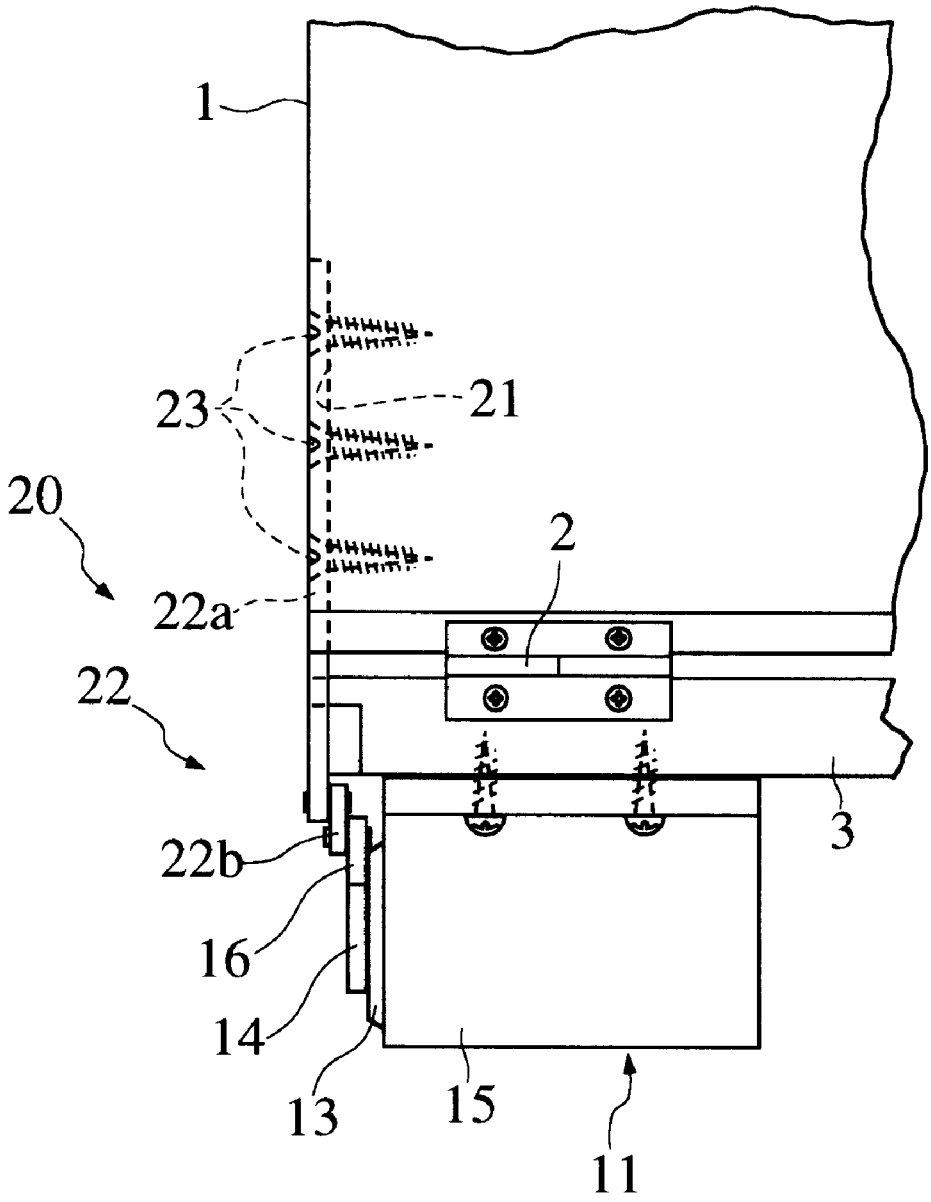
FIG. 5 is a fragmentary front elevation corresponding to FIG. 4.

Next, a closing control device according to a second embodiment will be described with reference to FIGS. 4 and 5. Referring to these figures, reference numeral 20 shows the closing control device of the second embodiment which is distinguished from the closing control device 10 of the first embodiment mainly in the manner of attaching the linkage to the fallboard 1. That is, while in the closing control device 10 of the first embodiment, the link bar 12*a* is fastened to the bottom of the rear end of the fallboard 1 by being screwed thereto, in the closing control device 20 of the present embodiment, a recess 21 is formed at a side of the fallboard 1 and a link bar 22*a* as a fallboard-side member of a linkage 22 is fixed in the recess 21. The recess 21 extends along the side of the fallboard 1 to open in the rear end surface of the fallboard 1, and has a depth and a length in agreement with corresponding dimensions of the link bar 22*a,* whereby the link bar 22*a* is received in the recess 21 with the outer surface of the link bar 22*a* being in flush with the surface of the side of the fallboard 1. The link bar 22*a* is fixed to the side of the fallboard by screws 23.

Further, the link bar 22*a* has a shape which is longer than the link bar 12*a* of the first embodiment. When the link bar 22*a* is fixed to the side of the fallboard 1, the braking force from the slow closing device 11 is applied as a shearing force to a joint (more specifically the screws 23) fixedly connecting the link bar 22*a* and the fallboard 1 with each other. Therefore, the link bar 22*a* is constructed as above so as to firmly fix the same to the fallboard 1 such that the joint is capable of reliably withstanding the shearing force. Further, in the present embodiment, the shaft 14 and the connection arm 16 are formed in one piece. The remainder of the arrangement of the second embodiment is similar to that of the first embodiment.

The slow closing device 20 of the second embodiment constructed as above operate quite in the same manner as the slow closing device 10 of the first embodiment. Therefore, similarly to the first embodiment, the fallboard 1 can not only be opened and closed in a stable manner, but also be closed slowly. Further, the fallboard 1 can be easily detached from the piano without using any tool or the like. Further, since the link bar 22*a* of the linkage 22 is received in the recess 21 of the side of the fallboard 1 such that the outer surface thereof is in flush with the surface of the side of the fallboard 1, the link bar 22*a* of the linkage 22 cannot be perceived from the front when the fallboard 1 is opened, which enhances the appearance of the piano.

Although in the above two embodiments of the invention, as the slow closing device 11, there is employed a one-way toque hydraulic damper, this is not limitative, but the one-way toque hydraulic damper may be replaced by any other suitable slow closing device. Further, although in the above embodiments, the invention is applied to the fallboard of the upright piano, this is not limitative, but it goes without saying that the invention may be applied to a fallboard of an electronic piano of an upright type.

INDUSTRIAL APPLICABILITY

According to the closing control device for a fallboard of the invention, it is possible to open and close a fallboard of an upright piano and an upright electric piano in a stable manner and slowly, as well as effect mounting and detaching of the fallboard from the piano without using any tool or the like.

We claim:

1. A closing control device for a fallboard of a piano having a body, comprising:

a fallboard support which is detachably mounted on said body of said piano, said fallboard being rotatably attached to said fallboard support;

a slow closing device which is fixed to said fallboard support for braking said fallboard when said fallboard rotates in a closing direction;

a first link bar secured to said fallboard; and a second link bar including a first end rotatably connected to said first link bar and a second end rotatably connected to said slow closing device.

2. A closing control device according to claim 1, wherein said slow closing device is fixed to a bottom of said fallboard support and said first link bar is fixed to said bottom of said fallboard.

3. A closing control device according to claim 1, wherein said first link bar has one end which is received in a recess formed in a side of said fallboard in a manner such that said first link bar is flush with said side of said fallboard and fixed in said recess.

4. A closing control device according to claim 1, wherein said body of said piano includes at least a pair of arms, said fallboard support being detachably mounted on said pair of arms.

5. A closing control device according to claim 4, wherein each of said pair of arms has at least two projections extending inward therefrom, said fallboard support having fallboard-fitting blocks extending from a bottom thereof, said fallboard support being detachably mounted on said pair of arms by fitting said fallboard-fitting blocks between respective sets of said at least two projections extending inward from each of said pair of arms.

6. A closing control device according to claim 1, wherein said slow closing device comprises a one-way torque hydraulic damper.

7. A closing control device according to claim 1, and further comprising at least one hinge by which said fallboard is rotatably attached to said fallboard support.

* * * * *